United States Patent [19]

Wenander

[11] 4,266,581

[45] May 12, 1981

[54] VACUUM TREATMENT UNIT

[75] Inventor: Harald S. Wenander, Nacka, Sweden

[73] Assignee: Tremix AB, Skarholmen, Sweden

[21] Appl. No.: 77,069

[22] Filed: Sep. 19, 1979

[30] Foreign Application Priority Data

Sep. 25, 1978 [SE] Sweden ..... 7810040

[51] Int. Cl.[3] ..... B65B 3/04

[52] U.S. Cl. ..... 141/65; 15/353; 15/413; 52/749; 406/170

[58] Field of Search ..... 425/219; 404/118, 119, 404/101, 75; 406/151, 170; 52/310, 503, 749; 15/321, 353, 413; 141/65, 66

[56] References Cited

U.S. PATENT DOCUMENTS 1,945,145 1/1934 Gordon ..... 404/75

2,226,466 12/1940 Heltzel ..... 404/119

2,244,297 6/1941 Heltzel ..... 404/119

*Primary Examiner*—Houston S. Bell, Jr.

*Attorney, Agent, or Firm*—Sughrue, Rothwell, Mion, Zinn and Macpeak

[57] ABSTRACT

A vacuum treatment unit for removing excess water from newly poured concrete. The unit comprises a vacuum pump connectable to at least two suction mats or the like via separate suction pipes. So that the pump will always obtain sufficient cooling, the suction pipes are readily disconnectably connected to the suction mats and said pipes are connected at their other ends to the vacuum pump via a settable valve device so constructed that at least one of the pipes is always connected to the suction side of the pump.

6 Claims, 5 Drawing Figures

VACUUM TREATMENT UNIT

The present invention relates to a vacuum treatment unit for removing excess water from newly poured concrete, and comprises a vacuum pump which is connectable via separate suction pipes to at least two suction mats or the like.

Vacuum treatment units of the general kind given above have been known for a long while. A rotary liquid ring compressor is suitably utilized as a vacuum pump in such units, and it has several known advantages. However, problems can occur if the water used in the liquid ring becomes too hot when this kind of pump is utilized. Such a condition can occur if the suction pipes are closed off by closure valves at the suction mats when treatment is terminated and while the pump is still on. Cooling water and air are no longer supplied to the pump via the suction pipes, and the pump sealing water, which usually circulates in a closed circuit, can be heated up to such a temperature, inter alia as a result of the inner friction in the pump, that the necessary vacuum can no longer be maintained, added to which seals and the like in the pump can also be damaged.

To avoid these hazards, and to allow the pump also to be operated with closed suction pipes, vacuum treatment units of the kind mentioned above are usually made with large cooling surfaces for the pump sealing water, a relatively large container for the water supply inter alia being connected between the suction side of the pump and the pipes connected to the suction mat. This container has at least one wall in common with a container through which the sealing water is allowed to pass. The disadvantage with these units is that they become relatively voluminous and heavy as a result of the large container volumes.

The main object of the present invention is to provide a vacuum treatment unit in which necessary cooling of the vacuum pump can be obtained without utilizing large container volumes.

When only one suction mat is connected to a vacuum pump, the risk of heating the sealing water to too high a degree can be eliminated by eliminating the possibility of turning off the suction pipe at the mat. The pipe can be provided with a quick-release connector instead, which allows simple disconnection from the respective connection to the suction mat. The pipe is thus always open, and thus during operation cooling water and air from the mat will pass through the pipe to the pump, whereas when the pipe is disconnected from the mat, cooling air coming directly from the surroundings can pass through the pipe to the pump.

However, this solution cannot be applied when more than one mat is connected to each vacuum pump, since as soon as one suction pipe is disconnected from one of the mats, the negative pressure in the other pipes will be too low for effective vacuum treatment.

This problem is eliminated in a vacuum treatment unit in accordance with the present invention, which is characterized by the combination of the suction pipes being readily disconnectably connected to the suction mats and that said pipes are connected to the vacuum pump via a settable valve means which is so constructed that at least one of the pipes is always in communication with the suction side of the pump.

A vacuum-treatment unit characterized by the combination mentioned above thus allows ready disconnection of the desired suction mats by physical disconnection of the associated suction pipes, whereas if the negative pressure is to be maintained in any of the other suction pipes, the valve means is set such that only these pipes are connected to the pump. Provided that one suction pipe is connected to a suction mat, sufficient cooling of the pump will be obtained in accordance with the above, as a result of the mixture of water and air flowing through the connected suction pipe. With the utilization of a valve means as mentioned, at least one of these pipes will be connected to the pump however, even though all the suction pipes are disconnected from their respective suction mats, the pump being sufficiently cooled with the help of the air flowing in through said suction pipe from the surroundings.

The unit in accordance with the invention thus meets the requirement for maximum suction action as long as one or more of the suction mats is connected and also meets the requirement for sufficient cooling of the vacuum pump in terminated suction operations, without requiring large volumes of cooling water.

In a preferred embodiment, the valve means comprises a rotatable plate with a hole for each suction pipe, said holes being adapted to coincide, in different combinations determined by the rotational position of the plate, with openings leading to the suction chamber of the pump.

In accordance with another embodiment, the valve means comprises a first plate with a hole for each suction pipe and a second plate disposed between the first plate and the pump, said second plate being provided with openings which are adapted for connecting the holes in the first plate with the openings leading to the suction chamber of the pump, in different combinations determined by the relative rotational position between said first and second plates. Said second plate being formed so that it can also serve as a sealing element.

The invention will now be described in detail with reference to an exemplary embodiment illustrated in the accompanying drawings.

Figure 1:
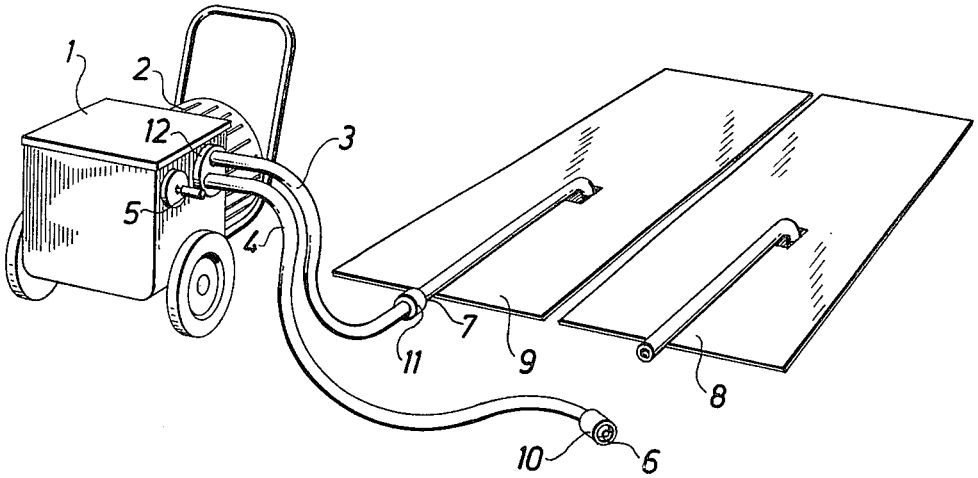
FIG. 1 illustrates a vacuum treatment unit in accordance with the invention provided with two suction mats.

The vacuum treatment unit according to FIG. 1 comprises a vacuum pump 1, e.g. a rotary liquid ring compressor, with a driving motor 2, and two suction connections to which pipes 3 and 4 are connected. An outlet is designated by 5. The suction pipes 3 and 4 are terminated with quick-release connectors 6 and 7, which in their simplest form can consist of tapering, conical pipes which are inserted into pipes associated with respective suction mats 8 and 9. The connections 6 and 7 are protected by muffs 10 and 11, which prevent the corresponding pipe mouth from coming into contact with the concrete when a pipe is disconnected. Otherwise particles of concrete could readily be drawn into the pump.

The suction pipe 3 is shown disconnected from the associated suction mat 8 in FIG. 1 while the pipe 4 is connected to the mat 9. In order to obtain the requisite negative pressure in the pipe 4, the pipe 3 must be shut off. This is carried out by means of a valve means 12 arranged at the pump, said valve means being hereinafter described with reference to FIGS. 2–5.

Figure 2:
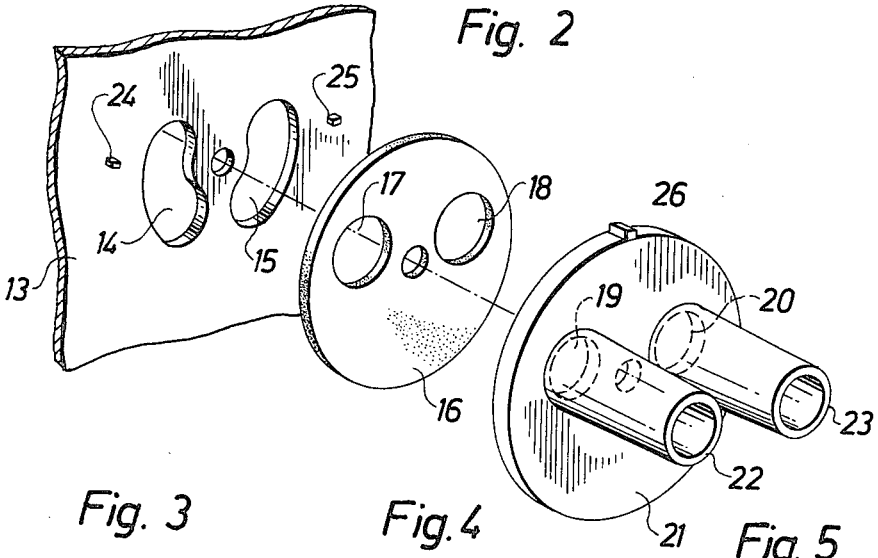
FIG. 2 is a schematic exploded view of a valve means which can be used in the unit of FIG. 1.

A portion of the wall to the suction chamber of the vacuum pump is denoted by 13 in FIG. 2, said wall being provided with two openings 14 and 15. A sealing plate 16 is disposed in sealing engagement against the wall 13, said plate being provided with two holes 17 and 18 coinciding with two holes 19 and 20 arranged in an outer plate 21, these holes being provided with two connection stubs 22 and 23. The plates 16 and 21 can be rotated together relative to the wall 13 about a central bolt (not shown).

Figure 3:
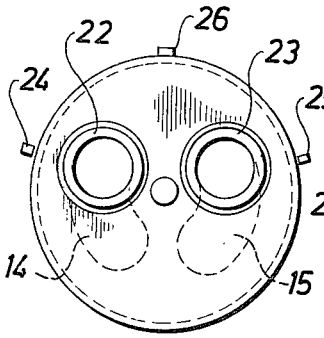
FIGS. 3–5 illustrate different positions of the valve means shown in FIG. 2.

In the angular position shown in FIG. 3, both holes in the plates 16 and 21 coincide with the openings 14 and 15 in the wall 13. The negative pressure on the suction side of the pump is thus distributed via the pipes 3 and 4 to both suction mats 8 and 9. The valve means is thus set in the position when both suction mats are to be active.

Figure 4:
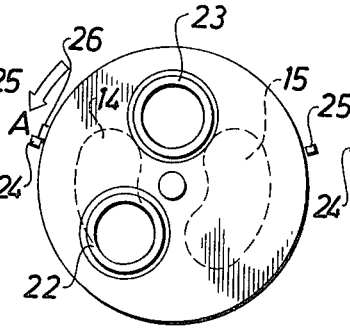

By turning the outer plates 16 and 21 in the direction of the arrow A in FIG. 4, the connection stubs 23 and the holes 20 and 18 in the plates 21 and 16 in register with said stub will be turned out of their coacting position with the opening 15 in the wall 13. The suction effect in the pipe 3 thus ceases. The stub 22 and associated holes 18 and 17 in the plates 21 and 16 do, however, continue to coact with the opening 14 in the wall 13, the subpressure being maintained in the suction pipe 4. This turning position corresponds to the state shown in FIG. 1, when the pipe 3 is disconnected from the associated suction mat while the pipe 4 is still connected and is under the required negative pressure.

Figure 5:
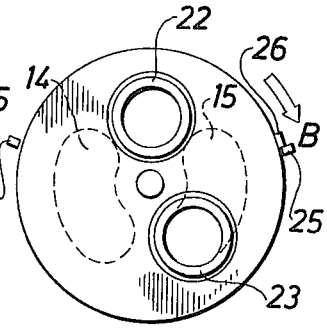

FIG. 5 illustrates the position taken by the plates 21 and 16 after being turned in the direction of the arrow B, compared with the starting position in FIG. 3. Contrary to what is illustrated in FIG. 4, the stub 23 in this case still remains in communication with the opening 15 in the wall 13 while the stub 22 no longer coacts with the opening 14. This is the reverse case to that illustrated in FIG. 1, since the suction mat 8 will be in use while the mat 9 is disconnected.

As will be seen from the description above, either one or the other or both of the suction mats together can be connected to the vacuum pump, effective suction action being obtained in all cases through the mat or mats connected. This also signifies that if neither of the mats is to be connected and if both suction pipes are disconnected from the mats, at least one suction pipe will be in communication with the suction side of the pump and supply the necessary amount of cooling air to the pump. The invention thus permits effective vacuum treatment with the desired combination of suction mats simultaneously as sufficient cooling is obtained during rest periods.

Two stops are denoted by 24 and 25, these stops being suitably arranged on the wall 13, while 26 designates a stop arranged on either of the plates 16 or 21. Distinct turning positions are obtained by coaction between these stops.

Although the invention above has been described in conjunction with two suction mats, it can naturally be applied to the case when more suction mats are used. The principle here is that the valve will be formed such that it allows desired combinations of suction mats to be connected to the vacuum pump, while not allowing all suction pipes to be cut off from the pump irrespective of the position to which the plates are turned.

The valve means described above can be modified, e.g. by providing the holes in the sealing plates 16 with a shape corresponding to the openings 14 and 15 in the wall 13, and allow the turning movement to take place between the plates 16 and 21. Then, the openings 14 and 15 in the wall 13 can have the form of circular holes, the openings 17 and 18 in the plate 16 forming, as a result of its thickness, flow passages between the plate 21 and the openings in the wall 13. The shape of the holes can be modified in other respects, e.g. each of the curved openings 14 and 15 can be replaced by a pair of circular holes. The valve function required for the invention can also be achieved with valves whose design is different to that described.

What is claimed is:

1. A vacuum treatment unit for removing excess water from newly poured concrete, comprising; a vacuum pump connectable to at least two suction mats or the like via separate suction pipes, said suction pipes being readily disconnectably connected to the suction mats, said pies being connected to the vacuum pump via a selectively settable valve means, said valve means being constructed such that at least one pipe is always in communication with the suction side of the pump.

2. A unit as claimed in claim 1, wherein said valve means comprises a rotatable plate having a hole for each suction pipe, said holes being adapted to coincide in different combinations determined by the rotational position of the plate, with openings leading to the suction side of the vacuum pump.

3. A unit as claimed in claim 1, wherein said valve means comprises a first plate having a hole for each suction pipe and a second plate disposed between said first plate and the vacuum pump, said second plate being provided with openings in communication with openings communicating with the suction chamber of the pump, and wherein the holes in the first plate and the openings in the second plate are disposed for mutual registery in different combinations determined by the relative rotational positions of said plates.

4. A unit as claimed in claim 1, wherein said valve means comprises a first plate having a hole for each suction pipe and a second plate disposed between said first plate and the vacuum pump, said second plate being provided with openings adapted for connecting the holes in the first plate with openings leading to the suction chamber by the pump, in different combinations determined by the rotational position of said second plate.

5. A unit as claimed in claim 3, wherein said second plate further comprises a sealing element.

6. A unit as claimed in claim 4, wherein said second plate further comprises a sealing element.

* * * * *